United States Patent [19]

Takeuchi et al.

[11] Patent Number: 4,485,660

[45] Date of Patent: Dec. 4, 1984

[54] PRESS SUBLIFTER WITH A MOVABLE GAUGE

[75] Inventors: Kunio Takeuchi; Takao Inamori, both of Toyota, Japan

[73] Assignee: Toyota Jidosha Kabushiki Kaisha, Toyota, Japan

[21] Appl. No.: 454,365

[22] Filed: Dec. 29, 1982

[51] Int. Cl.[3] ..... B21D 5/04

[52] U.S. Cl. ..... 72/313; 72/460; 33/181 R

[58] Field of Search ..... 72/312–315, 72/316, 381, 383, 386, 460, 461; 33/181 R

[56] References Cited

U.S. PATENT DOCUMENTS

| | | | |
|---|---|---|---|
| 389,912 | 9/1888 | Turner | 72/312 |
| 1,403,120 | 1/1922 | Kruse | 72/314 |
| 1,749,184 | 3/1930 | Hansen et al. | 72/381 |
| 1,787,151 | 12/1930 | Groehn | 72/383 |
| 2,105,289 | 1/1938 | Lobdell, Jr. | 72/316 |
| 2,878,769 | 3/1959 | Lyon | 72/313 |
| 3,953,999 | 5/1976 | Northey et al. | 72/381 |
| 4,019,236 | 4/1977 | Osman | 72/460 |

FOREIGN PATENT DOCUMENTS

| | | | |
|---|---|---|---|
| 49-69674 | 6/1974 | Japan | 72/421 |

*Primary Examiner*—Daniel C. Crane

*Attorney, Agent, or Firm*—Kenyon & Kenyon

[57] ABSTRACT

A movable guide gauge for accurately locating an edge of a preformed sheet placed on a lower die of an edge bending press is fixed to a cam follower slidably mounted on a sublifter and spring-loaded toward a retracted position away from a bending edge of the lower die. A cam mounted above the cam follower alongside an upper die has a slanted surface corresponding to the slanted surface of the cam follower, the slanted surfaces being designed so that they are brought into abutting slidable engagement with each other to move the guide gauge from the retracted position to a predetermined position for guiding the edge of the workpiece as the cam moves downward with the upper die.

7 Claims, 3 Drawing Figures

PRESS SUBLIFTER WITH A MOVABLE GAUGE

BACKGROUND OF THE INVENTION

1. Field of the Invention

The present invention relates to a sublifter for use in press-bending sheet-like workpieces.

2. Prior Art

If workpieces of different materials are bent at the edges of the workpieces differ with each material, and the dimensions of the edges vary when the workpieces are released to their free state. When a workpiece is then placed in a bending die in which the workpiece is to be located with reference to its edge, if the position of the edge varies even to a slight degree poor quality in the final product will result. With the conventional practice of employing a guide gauge fixedly mounted on a lifter for positioning the workpiece, it has been necessary to loosen a bolt that fastens the guide gauge and reposition the guide gauge for each different workpiece material to avoid this problem.

SUMMARY OF THE INVENTION

Therefore, an object of the present invention is to provide a sublifter with a movable gauge which overcomes the above problem.

More specifically, the object of the present invention is to provide a sublifter with a movable gauge which reliably locates the edge of a workpiece, thereby producing a high quality product with negligible dimensional error.

Another object of the present invention is to provide a sublifter with a movable gauge which provides automatic positioning even when the material of a workpiece is changed, thereby eliminating the labor conventionally necessary for adjusting the position of the guide gauge.

According to the present invention, a guide gauge is slidably mounted on a press sublifter and is ordinarily urged toward a retracted position away from a press die, the guide gauge being shifted to a predetermined gauging position by a cam movable with an upper die of the press, when the upper die is moved downward toward the press die. As the gauge moves toward the press die it engages the edge of the workpiece and presses the workpiece firmly against the surface of the press die. Thereby, the edge of the workpiece is accurately located at a predetermined place.

These and other objects and features of the invention will become apparent upon reading the following description of the invention with reference to the attached drawing, with the understanding that modification and variations of the invention can be made by those skilled in the art within the scope of the appended claims, without departing from the spirit of the invention.

DETAILED DESCRIPTION OF THE INVENTION

The sublifter with a movable gauge according to the invention will be explained in detail with reference to the drawings.

Figure 1:
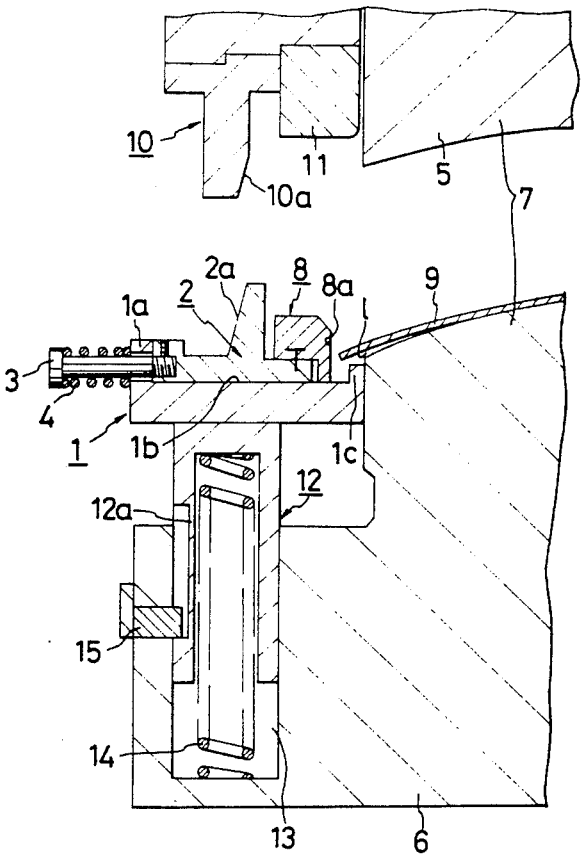
FIG. 1 is a vertical sectional view of an embodiment according to the present invention.

In FIG. 1, a channel-shaped sublifter plate 1 has a flat base surface 1*b* and upstanding right and left side flanges 1*c*, 1*a*, respectively. On the flat portion 1*b* a cam follower 2 is mounted for sliding movement with respect to a press die assembly 7 having upper and lower dies 5, 6. To the left side of the cam follower is a headed bolt 3 extending through a hole bored in the upstanding left side flange 1*a*. A spring placed around the bolt between its head and the left side wall of the upstanding left side flange 1*a* urges the cam follower 2 away from the press die assembly 7.

The cam follower 2 has an almost T-shape in section, including an upwardly extending leg with a slanted surface 2*a* facing away from the press die assembly. A guide gauge is mounted by appropriate means such as pins, bolts, etc. onto the cam follower at a side adjacent to the press die assembly 7. The guide gauge has a workpiece guide surface 8*a* facing a press die assembly 7 for guiding and locating an edge of a workpiece 9 placed on the lower die 6.

The bottom surface of the sublifter plate is provided with a cylindrical support member 12 which is inserted into a hole 13 bored in a side portion of the lower die. As shown in the drawing, the support member has a central hole into which a spring 14 is inserted for urging the sublifter upwardly. In the outer circumference of the support member is a longitudinal guide slot 12*a* which slidably engages a stop member 15 mounted on the side portion of the lower die for limiting the vertical movement of the support member to a prescribed range.

Although the support member 12 is shown as being slidably held in a hole bored in the side portion of the lower die, this arrangement is not intended to be limiting. The support member may be supported by any appropriate base member.

A cam 10 disposed on the side portion of the upper die 5 also has an almost T-shape in section, with a slant surface 10*a* adapted to be brought into abutting slidable engagement with the slanted surface 2*a* of the cam follower 2. A press member 11 mounted on the side of the upper die next to cam 10 is adapted to bend an edge portion of a workpiece 9 by pressing the edge portion down along a side of the lower die 6. In the operation of the press, the cam 10 and the press member 11 first move in conformity with the downward motion of the upper die 5, and then the former two are further driven downwardly to carry out the bending step after the upper and lower dies clamp the workpiece between them. The upper die, the cam, and the press member are moved upwardly or downwardly by an appropriate means (not shown) conventional to this type of press. The slant surfaces 2*a* and 10*a* of the cam follower and the cam, respectively, are designed so that when they slidably engage each other, the guide gauge mounted on the sublifter is shifted to the right to a predetermined position for locating the edge of the workpiece.

Figure 2:
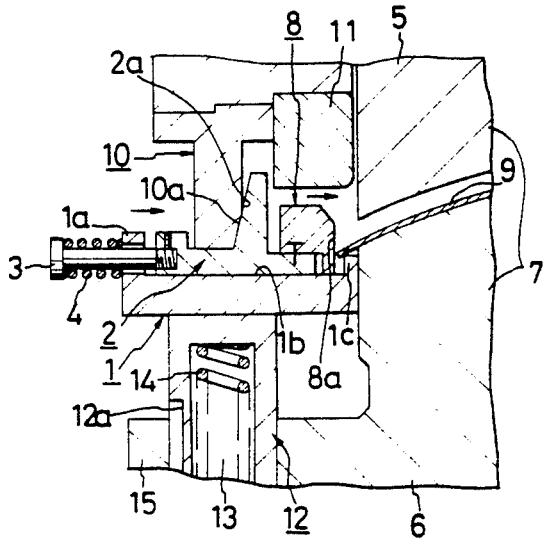
FIGS. 2 and 3 are sectional views of the principal portion of the embodiment of FIG. 1 in two stages of operation.
Figure 3:
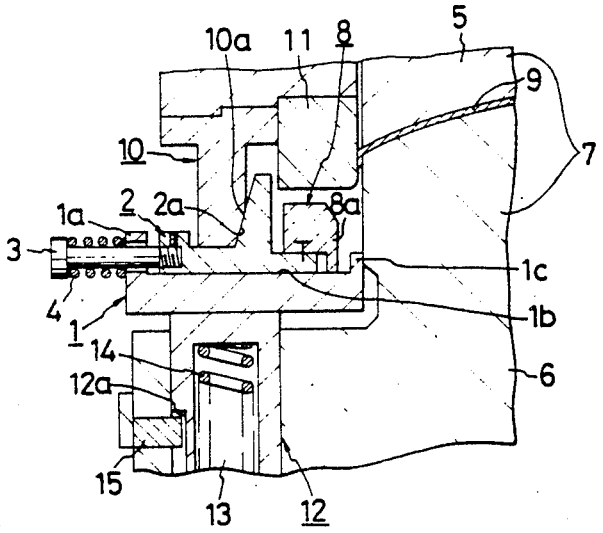

The sublifter with a movable gauge, as described above, operates as follows:

A workpiece 9 is fed between the upper and lower dies 5, 6. As the upper die 5 is lowered, as shown in FIG. 2, the slant surface 10*a* of the cam 10 begins to be brought into contact with the slant surface 2*a* of the cam follower 2 and slide therealong, causing the cam follower 2 to be displaced in a horizontal direction until the guide surface 8a of the guide gauge 8 contacts the edge of the workpiece 9. Further lateral movement of the gauge as the cam 10 continues to descend presses the edge of the workpiece downwardly into firm contact with the curved surface of the lower die 6, thereby locating the edge of the workpiece accurately and automatically with relation to the side edge of the lower press die 6. In this way, a clearance l (See FIG. 1) which may occur between the edge portion of the unrestrained workpiece and the upper surface of the lower die 6, depending on the material of the workpiece, will be eliminated before the gauge reaches its locating position, thereby minimizing any locating error. When the upper die 5 descends further, the workpiece 9 is firmly sandwiched between the upper and lower dies. As shown in FIG. 3, the sublifter plate 2 as well as the fixed cam 10 and the press member 11 continues to move downward, so that the edge portion of the workpiece 9 is pressed against the side wall of the lower die 6 by means of the press member 11, thereby bending the edge portion over.

After the bent portion is formed at the edge portion of the workpiece, the upper die is lifted to release the force by which the cam follower 2 is pressed laterally by the cam 10 to allow the cam follower 2 to retract to its initial position due to the force of the spring 4.

The foregoing cycle of pressing operation is repeated to bend workpieces 9 successively fed into the press die 7 for the production of high quality products such as automobile body panels with smaller dimensional error.

As mentioned above, according to the present invention, a guide gauge is slidably mounted on a sublifter, the guide gauge being resiliently urged to retract away from the press die assembly and being driven to a predetermined position in response to the downward movement of a cam. Therefore, the edge of the workpiece can be accurately located during the pressing stroke of the die, thereby enabling the manufacture of high quality products with smaller dimensional errors. Further, according to the present invention, the guide gauge will automatically locate the edge of a workpiece at a predetermined position even when different workpiece materials are pressed, thereby eliminating the labor needed to readjust the position of conventional guide gauges that are fixed to a sublifter.

We claim:

1. A movable guide gauge assembly for accurately positioning the edge of a workpiece in a sheet metal press having a lower die with a generally horizontal top surface, an upper die having a bottom surface conforming to the top surface of the lower die, the upper die being movable toward and away from the lower die, and a sublifter positioned adjacent to an edge of the upper surface of the lower die, wherein the movable guide gauge assembly comprises:

a cam follower mounted on the sublifter and movable with respect thereto toward and away from an edge of the lower die between a retracted position and a gauging position, the cam follower having a surface inclined from the vertical and facing away from the lower die;

means for urging the cam follower away from said edge of the lower die toward the retracted position;

a guide gauge fixed to the cam follower and having a guide surface for locating an edge of a workpiece placed on the upper surface of the lower die with respect to said edge of the lower die;

a cam disposed above the sublifter adjacent to the upper die and having an inclined surface corresponding to the inclined surface of the cam follower and facing toward the lower die, the cam being movable in cooperation with, and parallel to the direction of, movement of the upper die so that the inclined surface of the cam engages the inclined surface of the cam follower to move the cam follower from said retracted position to said gauging position as the upper die moves toward the lower die;

means for mounting the sublifter for movement relative to the lower die in a direction parallel to the direction of movement of the upper die between predetermined upper and lower limits; and means for urging the sublifter toward said upper limit.

2. A movable guide gauge assembly according to claim 1, wherein said edge of the lower die is a bending edge, and the press further includes a press member disposed above the sublifter and having a forming edge, the press member being movable downward with said cam such that said forming edge moves past the bending edge of the lower die after the cam has moved the cam follower to said gauging position.

3. A movable guide gauge assembly according to claim 1, wherein the means for urging the cam follower toward the retracted position comprises a compression spring disposed between the sublifter and the cam follower.

4. A movable guide gauge assembly according to claim 1 wherein the means for mounting the sublifter for movement relative to the lower die comprises:

a base member fixed relative to the lower die and having a cylindrical hole therein, the axis of the hole being parallel to the direction of the movement of the upper die and a hollow cylindrical support member attached to the bottom of the sublifter and slidably disposed within the hole in the base member; and the means for urging the sublifter toward said upper limit comprises:

a compression spring disposed coaxially within the cylindrical support member with the bottom of the spring in contact with the base member and the top of the spring in contact with the support member.

5. A movable guide gauge assembly according to claim 4 further comprising means for restricting movement of the sublifter between said upper and lower limits.

6. A movable guide gauge assembly according to claim 5 wherein the movement restricting means comprises a longitudinal slot in the outer surface of the cylindrical support member and a projection extending inward from the inner surface of the hole in the base member and slidably engaged in the slot, the slot having lower and upper ends that contact the projection when the sublifter is in the upper and lower limit positions, respectively.

7. A movable guide gauge assembly for accurately positioning the edge of a workpiece in a sheet metal press having a lower die with a generally horizontal top surface, an upper die having a bottom surface conforming to the top surface of the lower die, the upper die being movable toward and away from the lower die, and a sublifter positioned adjacent to an edge of the upper surface of the lower die, wherein the movable guide gauge assembly comprises:

a cam follower mounted on the sublifter and movable with respect thereto toward and away from an edge of the lower die between a retracted position and a gauging position, the cam follower having a surface inclined from the vertical and facing away from the lower die;

means for urging the cam follower away from said edge of the lower die toward the retracted position;

a guide gauge fixed to the cam follower and having a guide surface for locating an edge of a workpiece placed on the upper surface of the lower die with respect to said edge of the lower die;

a cam disposed above the sublifter and having an inclined surface corresponding to the inclined surface of the cam follower and facing toward the lower die, the cam being movable in cooperation with, and parallel to the direction of, movement of the upper die so that the inclined surface of the cam engages the inclined surface of the cam follower to move the cam follower from said retracted position to said gauging position as the upper die moves toward the lower die; and wherein the guide surface of the guide gauge is positioned at an acute angle with respect to the top surface of the lower die adjacent said edge thereof so that the guide surface will press the contacted edge of a workpiece firmly down against the top surface of the lower die when the guide gauge is in the gauging position.

* * * * *